United States Patent [19]

Rusbach

[11] 4,135,451

[45] Jan. 23, 1979

[54] FUZE PLUG, PARTICULARLY FOR USE IN A HAND GRENADE

[75] Inventor: Maurice Rusbach, Nyon, Switzerland

[73] Assignee: Sarmac S.A., Geneva, Switzerland

[21] Appl. No.: 793,434

[22] Filed: May 3, 1977

[30] Foreign Application Priority Data

May 28, 1976 [CH] Switzerland ..... 6751/76

[51] Int. Cl.[2] ..... F42B 27/02

[52] U.S. Cl. ..... 102/64; 102/254; 102/278

[58] Field of Search ..... 102/64, 65, 76, 78, 102/79, 80, 85, 85.6, 254, 278

[56] References Cited

U.S. PATENT DOCUMENTS

| | | | |
|---|---|---|---|
| 1,310,046 | 7/1919 | Asbury | 102/79 |
| 2,872,866 | 2/1959 | Brown et al. | 102/64 |
| 3,451,340 | 6/1969 | Batou | 102/76 |
| 3,505,959 | 4/1970 | Lohnert et al. | 102/65 X |
| 3,616,753 | 11/1971 | Carlson | 102/64 |
| 3,683,814 | 8/1972 | Bedall et al. | 102/64 |

FOREIGN PATENT DOCUMENTS

| | | |
|---|---|---|
| 1423817 | 4/1967 | France. |
| 2216548 | 8/1974 | France. |

*Primary Examiner*—Verlin R. Pendegrass
*Attorney, Agent, or Firm*—Young & Thompson

[57] ABSTRACT

The invention relates to a fuze plug for hand grenade comprising a rotative drum having two axial bores having respectively a detonator and its propulsive charge and a pyrotechnic timer. In active position of the drum the detonator is aligned with a chamber provided in the explosive charge of the grenade and the pyrotechnic timer is operatively connected to a primer. In safety position of the drum physical barriers are interposed between the detonator and the explosive charge of the grenade as well as between the pyrotechnic timer and the primer.

6 Claims, 7 Drawing Figures

FUZE PLUG, PARTICULARLY FOR USE IN A HAND GRENADE

The present invention relates to fuze plugs particularly for use in a hand grenade, of the type comprising a pyrotechnic train fired by a percussion point which is maintained in inactive position by a handle locked in safety position.

The aim of the present invention is to increase the security of such a fuze plug, so that the grenade will not be ignited even if the percussion point is accidentally liberated.

This fuze plug comprising a body intended to be screwed on a grenade is distinguished in that this cylindrical body houses an angularly displacable drum with respect to said body; in that this drum comprises two axial bores, one of the bores containing a detonator and a propulsive charge whereas the other contains a pyrotechnic timer; in that the drum comprises a radial passageway through its wall leading to the bore containing the pyrotechnic timer, this passage way being in active position of the fuze plug in front of a bore of the body giving access to a housing containing a primer.

The attached drawings show schematically and by way of example two embodiments of a fuze plug fixed on a hand grenade.

Figure 3:
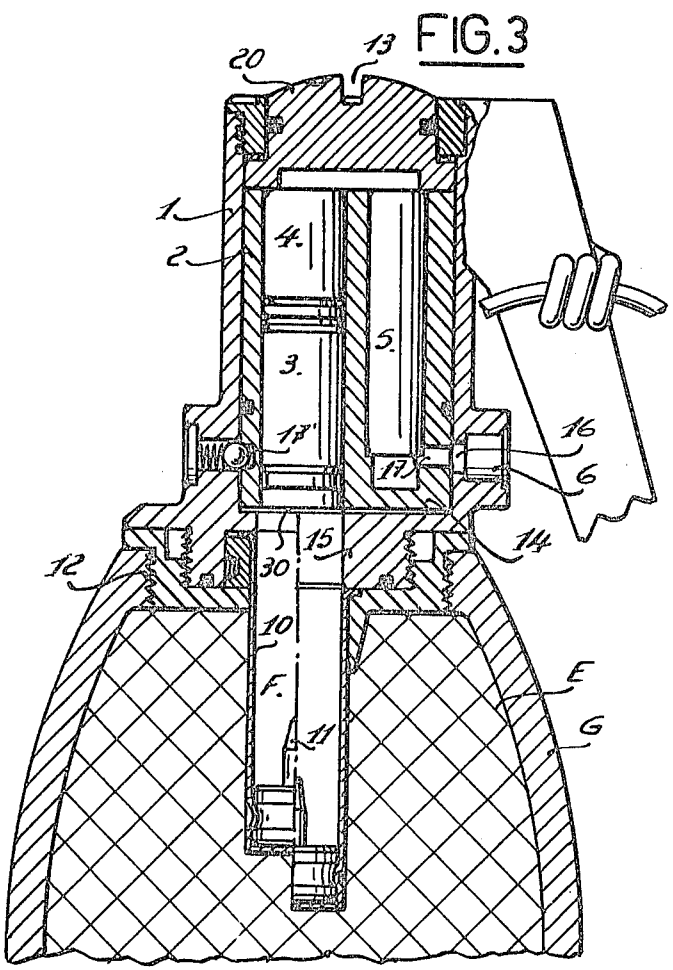
FIG. 3 is a cross-section of the fuze plug in active position.

This fuze plug improves the security of the antipersonnal type of hand grenade and respects the requirements now in force.

The handling security is complete due to the use of the fuze plug having a double security.

The security is double due to the fact that the fuze comprises supplemental security means to that achieved by the locking of the handle. An accidental opening of the handle remains thus without effect.

The design of the fuze plug avoids totally, up to arming, the potential danger of an accidental explosion, whatever the cause: fire, crushing, opening of the handle and so on.

Of simple construction, the fuze plug is mainly constituted by a body 1 which houses and assembles all the constitutive elements for its operation so that this homogeneous assemply is screwed onto the grenade G to complete the same.

This grenade comprises, located in its body G, having only one aperture, an explosive mass E provided with a cylindrical central void F in which a casing is fixed which is provided with a percussion point 11 at its end located within the explosive mass.

The body 1 contains a cylinder or drum 2 having two bores in the direction of its length and aligned on a same diameter. One of the bores houses a conventional detonator 3 and a conventional propulsive charge 4 therefor, the other bore contains a pyrotechnic timer 5. A firing primer 6 is located and fixed in a protuberance of the body 1. In front of and above this primer is located the percussion point 7 which is retained in armed position by an ejectable handle 8, locked (in that embodiment) through the hollow shaft 9 of the percussion point. A casing 10 comprising a fixed percussion point 11, mounted coaxially to the thread 12, completes the assembly.

The passage from the security position to the service position is obtained by a rotation of 180° of the drum 2, using a screwdriven slot 13, as illustrated, or in an alternative embodiment (not shown), by a lever fast with the drum, or further by a sleeve, comprising the handle and the percussion point, and pivoting on the cylindrical part of the body and so on.

Figure 1:
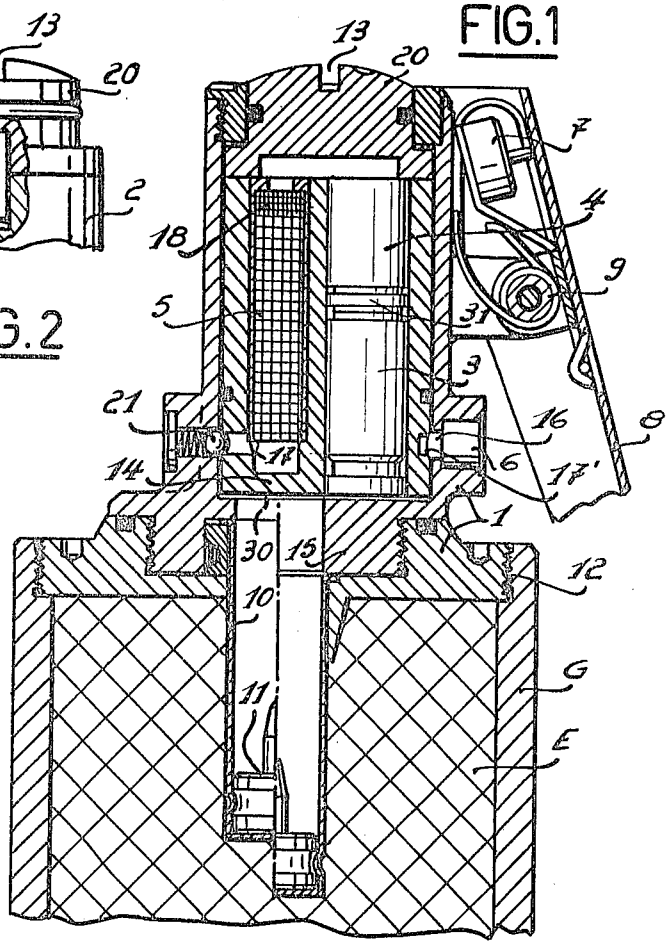
FIG. 1 shows in cross-section the fuze plug in inactive position.

In the security position (FIG. 1), the pyrotechnic timer 5 is aligned on the casing 10 which carries the percussion point 11, and separated from it by a physical barrier formed by the bottom 14 of the bore which is a dead hole.

Therefore, the detonator 3 and its propulsive charge 4 are isolated and are disposed above a physical barrier, formed by the bottom 15 of the body 1.

Under these conditions, the passageway 16 of the primer 6 is closed by the drum 2. The primer, in case of an accidental firing, cannot have any action either on the pyrotechnic timer 5, or on the detonator 3 or on its propulsive charge 4.

It is to be noted that as all the pyrotechnic means are located outside of the grenade and separated from it by physical barriers, the firing of one of them or even of all three of them would be without effect.

In service position (FIG. 3), after a rotation of 180° of the drum 2, the bore containing the detonator 3 coincides with the bore of the casing carrying the percussion point 11. At the same time, the pyrotechnic timer 5 is connected to the primer 6 through its firing passage way 17 and the passage way 16 which is in front of it.

After unlocking and throwing the grenade, the handle 8 opens and is ejected, the percussion point 7 which is liberated strikes the primer 6 which fires the pyrotechnic fuze or timer 5, which in its turn, after about five seconds of combustion, fires the lounching or propulsive charge 4, which projects the detonator 3 through the casing against the percussion point 11. The bursting of the detonator is thus produced in the center of the explosive mass E, which therefore explodes in turn.

An aluminothermal timer 18 may be provided between the pyrotechnic timer 5 and the propulsive charge 4 of the detonator 3, to achieve a delay of at least one second, permitting to launch the grenade to a distance sufficient to avoid any accident, in the case where the pyrotechnic timer would function too rapidly.

Figure 2:
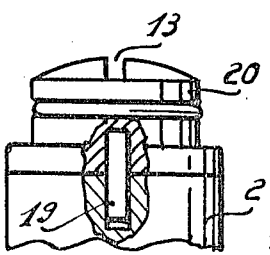
FIG. 2 is a detail of the side of the fuze plug.
Figure 4:
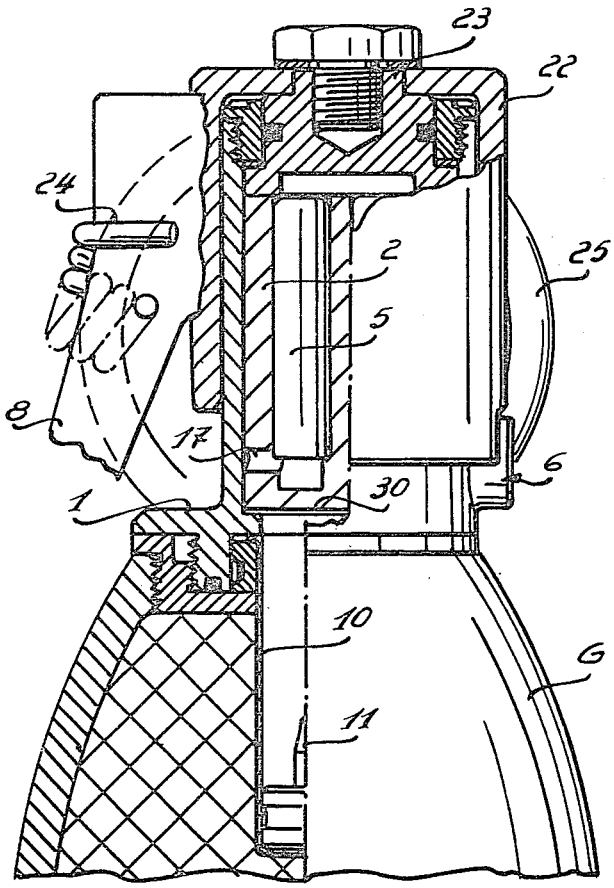
FIG. 4 is a cross-section of a second embodiment of the fuze plug in inactive position.
Figure 5:
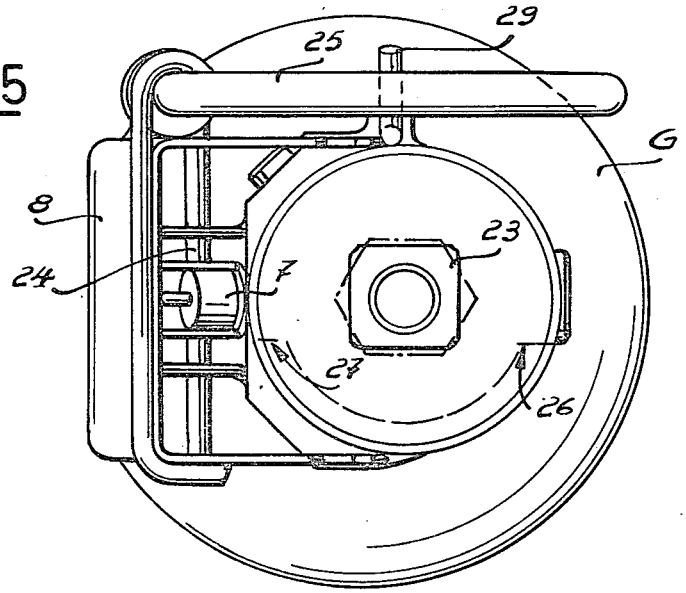
FIG. 5 is a top view of the fuze plug shown in FIG. 4.
Figure 6:
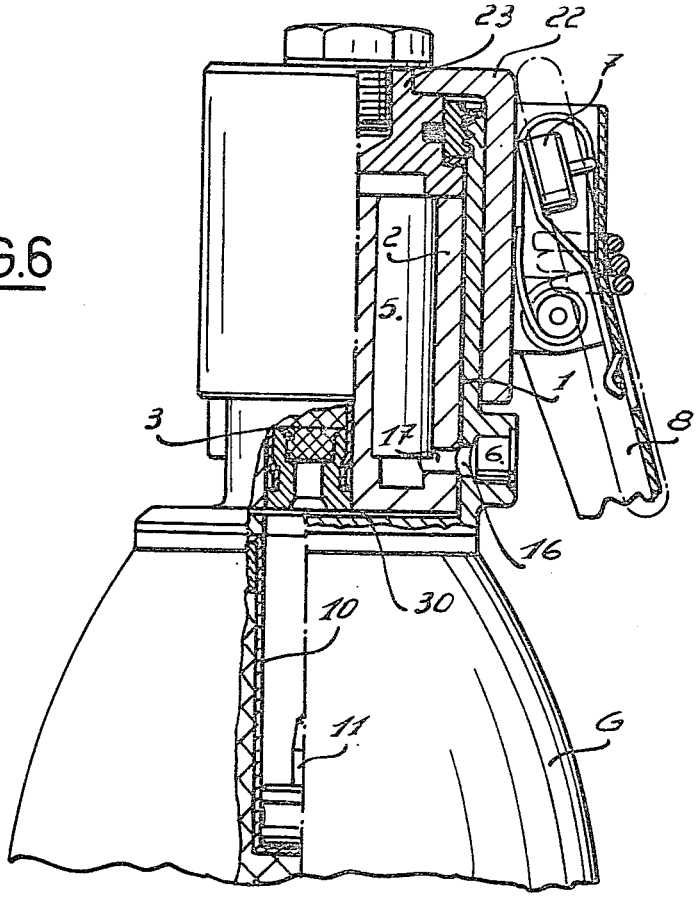
FIG. 6 is a cross-section of the fuze plug shown in FIG. 4, in active position.
Figure 7:
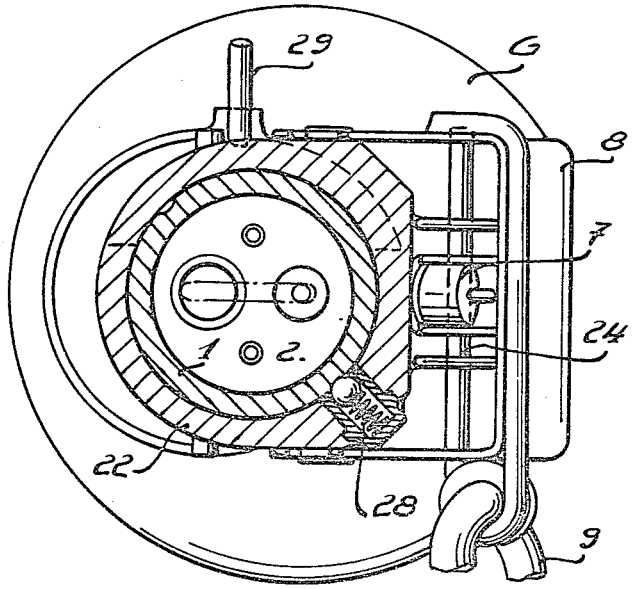
FIG. 7 is a top view, partly in section of FIG. 6.

FIG. 2 shows the way in which the drum 2 is angularly fastened to the driver 20 having the slot 13, by means of a pin 19.

A ball lock 21 having snap action engagement with the passage way 17, or with a notch 17' of the drum, defines the two angular positions of this drum.

The second embodiment shown at FIGS. 4 to 7 differs from the first one in the manner in which the drum is driven in rotation.

The socket 22 coaxial with the body 2 and carrying the handle 8 and the percussion point 7 is able to drive the drum 2 in rotation through the square 23 (or other driving shape, hexagon; pin, and so on.) The socket 22 carries the ejectable handle 8 and its shafts, the percussion system 7 with the pin 24 and its ring 25.

In secured position, the assembly handle-percussion point is located at 180° opposite the primer 6. This primer would thus not be fired in case of an accidental opening of the handle. This position is defined by the abutment 26 against the protuberance of the primer 6. These abutments 26 and 27 are made by machining on the socket 22.

The ball 28 and its spring provide for a resilient lock to maintain the socket 22 in one of the positions "secured" or "armed".

In secured position, the ring 9 is maintained by a resillient pin 29, thus the user is sure that the plug is in the secured position since he cannot pull out the ring without taking out the pin 29.

By thus controlling in which direction the socket is able to turn, one may know if the grenade is "armed" or "secured".

It is to be noted that the direction along which the ring has to be pulled is opposite to the abutment 27.

This embodiment has the advantage that it is easy to maintain a grenade in total safety up to the last moment before its use. When the grenade is not to thrown it can be reset in security position. This embodiment avoids the use of an independent tool In all cases a metal sheet 30 maintains the detonator in retracted position, even in the active position of the drum 2, as long as it is not broken by the charge, 4 and this despite the fact that the detonator 3 is provided with a joint 3' and is maintained by friction in the bore of the drum. These joints ensure sealing so that the envelope of the detonator forms a piston to project against the percussion point through the firing of the propulsion charge 4.

I claim:

1. Fuze plug, particularly for a hand grenade, comprising a body and a casing extending from said body, housing a fixed percussion point, intended to be screwed on a grenade, characterized by the fact that said body houses an angularly displacable drum with respect to said body; in that this drum comprises two axial bores, one of the bores containing a detonator and a propulsive charge whereas the other contains a pyrotechnic timer; in that the drum comprises a radial passage way through its wall leading to the bore containing the pyrotechnic timer, this passage way being in active position of the fuze plug in front of a bore of the body giving access to a housing containing a primer.

2. Fuze plug according to claim 1, characterized by the fact that it comprises a driver accessible frome the outside to cause the rotation of the drum with respect to the body.

3. Fuze plug according to claim 2, characterized by the fact that the driver comprises an actuating slot.

4. Fuze plug according to claim 2, characterized by the fact that the driver is formed of a skirt, surrounding the body, comprising a handle and a movable percussion point, rotatively mounted on the body and cooperating through a driving formation with the drum.

5. Fuze plug according to claim 1, characterized by the fact that it comprises a casing enabling to fix it onto a grenade, housing a fixed percussion point; this casing extending in service position into the explosive mass of the grenade.

6. Fuze plug according to claim 1, characterized by the fact that it comprises a spring-urged ball locking device for releasably determining the position of the drum relative to the body.

* * * * *